US006286150B1

(12) United States Patent
Miller et al.

(10) Patent No.: US 6,286,150 B1
(45) Date of Patent: Sep. 11, 2001

(54) PROTECTION OF A GARMENT AGAINST EXTERNALLY APPLIED MECHANICAL WEAR

(75) Inventors: Melodie Dawn Miller, 151 Finch Pl. SW. Suite C, Bainbridge Is., WA (US) 98110; Kurt Fredrick Gray, Boulder, CO (US)

(73) Assignee: Melodie Dawn Miller, Poulsbo, WA (US)

( * ) Notice: Subject to any disclaimer, the term of this patent is extended or adjusted under 35 U.S.C. 154(b) by 0 days.

(21) Appl. No.: 09/499,119

(22) Filed: Feb. 7, 2000

(51) Int. Cl.[7] ..... A41D 13/00
(52) U.S. Cl. ..... 2/232; 2/455
(58) Field of Search ..... 2/455, 69, 459, 2/16, 59, 60, 108, 227, 242, 232, 79, DIG. 1

(56) References Cited

U.S. PATENT DOCUMENTS 1,144,150 * 6/1915 Marcovsky ..... 2/69
1,691,057 * 11/1928 Greilich ..... 2/242
1,823,458 * 9/1931 Mayer ..... 2/242
3,733,615 * 5/1973 Jaffee ..... 2/232
3,801,986 * 4/1974 Purdon ..... 2/69
3,945,042 * 3/1976 Lobo ..... 2/455
4,408,600 * 10/1983 Davis ..... 128/80 R
4,451,934 * 6/1984 Gioello ..... 2/113
5,337,418 * 8/1994 Kao et al. ..... 2/455

* cited by examiner

*Primary Examiner*—John J. Calvert
*Assistant Examiner*—Tejash Patel
(74) *Attorney, Agent, or Firm*—Christopher Duffy

(57) ABSTRACT

Garments such as ski pants are often scraped by the strokes of an abrasive device, i.e., the edges of the opposing skis, when worn by a user. In one embodiment of the invention, elongated abrasion-resistant ribs are overlaid on the area of a pant leg scraped by the device, to provide a corduroyed effect of alternately successive relatively raised ribs and recessed grooves thereon, the ribs of which have a height adapted to sustain the ski edges above the bottoms of the grooves so that the bottoms of the grooves are protected from abrasion. In another embodiment, a slot is formed in the pant leg at that area, and a patch of a flexible substrate material, with an array of ribs and grooves thereon, is inserted in the slot and secured to the pant leg to provide a corduroyed surface having the capability of protecting the area from the abrasive action of the ski edge. Various types of ribs are shown, including ones made of an abrasion-resistant polymer material and ones made of a reinforced cloth material which is abrasion material.

28 Claims, 5 Drawing Sheets

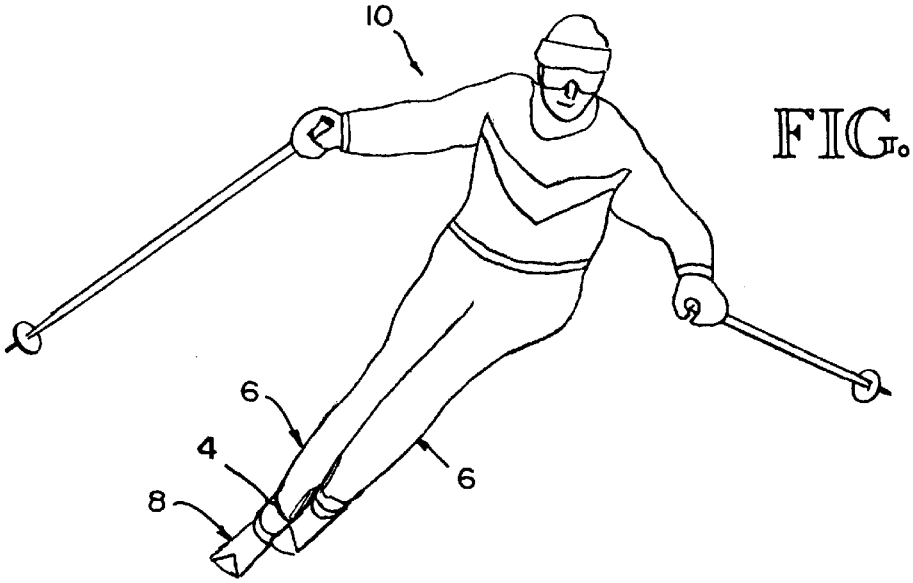
FIG. 1
FIG. 3
FIG. 2
PRIOR ART
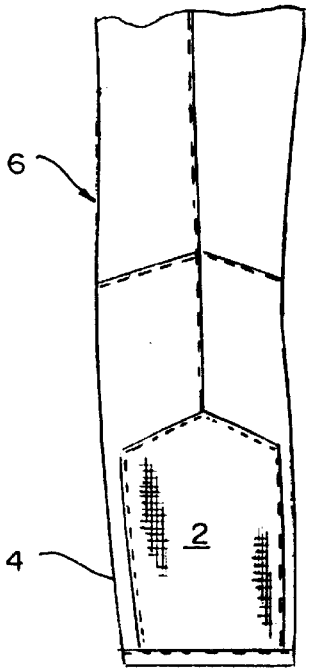
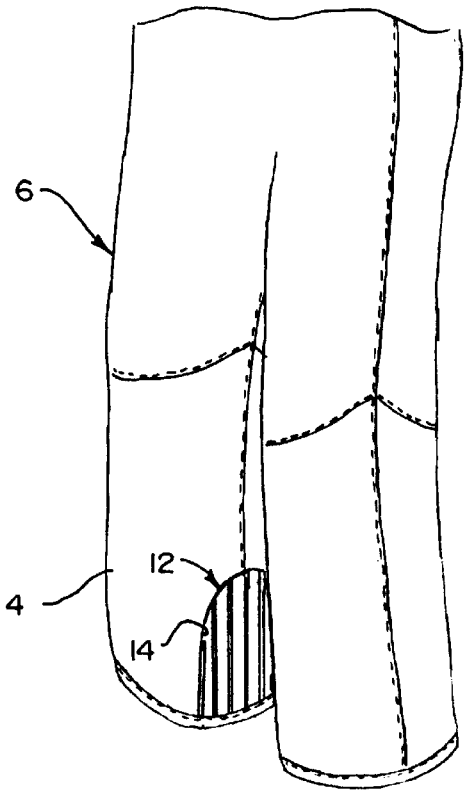

PROTECTION OF A GARMENT AGAINST EXTERNALLY APPLIED MECHANICAL WEAR

TECHNICAL FIELD

Our invention relates to the protection of a garment against externally applied mechanical wear, and in particular, to a means and technique for protecting a localized area of the garment which is scraped by the strokes of an externally applied abrasive device when the garment is worn by a user.

BACKGROUND ART

An example of such a garment is a pair of ski pants, or a bib pant suit, and an example of such a device is a ski and particularly, the inside edge of the ski. When a skier makes a downhill run, he (or she) maintains control of his body in part by leaning to one side or the other while positioning his ankles and feet in close proximity to one another so as to place his center of gravity well outside the position of his feet. In doing so, the inside edge of one of his skis is stroked relatively up and down and perhaps fore and aft of the ankle of his other leg, and usually so close to it as to scrape the ankle portion of the pantleg surrounding his other leg. The repeated strokes of the ski have an abrasive effect on the ankle portion of the pantleg, and may even cut into or tear the ankle portion unless something is done to protect it against the abrasive action of the ski.

A similar but less likely effect can occur when skies are being transported to or from a site for skiing, and over one shoulder of the skier. Therefore, protection may also be needed at the shoulders of the skier's garment, and according to our invention, protection may be provided at any site desired on the garment of a skier or other user.

As used herein, the term "garment" is inclusive of a single piece garment covering the user's entire body from head to toe, or a multi-piece garment having two or more components covering, for example, the user's legs and crotch, and separately, the user's upper trunk, such as in the case of a jacket and pant combination or a jacket and bib pant combination. The term usually also suggests outerwear, though there may be an occasion when the garment is worn other than in the outside air.

Skier's have long had garments available to them with protective reinforcement on the ankle portions of the pantlegs of the garment to minimize the cumulative effect of the opposing ski edges scraping the ankle portions during skiing. But this protective reinforcement was heretofore in the form of a heavy, relatively stiff nylon broadcloth material which was superimposed on the inside of the ankle portion of each pantleg as a plain surfaced patch of the same that was extensive enough in area to intercept the ski edge there opposite when the edge was relatively stroked across the ankle portion. Each patch was sewn or otherwise secured to the ankle portion, or incorporated into the pantleg as a laminate therewith, and effectively operated as a relatively hard non-flexible "spot" on the ankle portion that added to its weight and to the difficulty of closing the ankle portion about the user's own ankle. The patch also added weight to the garment as a whole, and had little ornamental value in that manufacturers were forced to purchase a minimum lot or quantity of the patch material, say, a thousand yards at a minimum, and since that quantity provided the patches for many garments, typically they chose only black for the patch material, since to assemble two or more colors, would take a production of far too many garments to consume the minimum allotment of each color.

DISCLOSURE OF THE INVENTION

According to our invention, we now protect a localized area of a ski pant, jacket or other garment which is scraped by the strokes of an externally applied abrasive device when the garment is worn by a user, by forming a corduroyed surface of alternately successive relatively raised ribs and recessed grooves on the area, and raising the ribs of the surface relatively peripherally outwardly from the bottoms of the grooves to a height at which, in relation to the width of the grooves, the ribs will sustain the strokes of the device at an elevation above the bottoms of the grooves at which the area of the garment is protected from abrasion.

To illustrate, in many of the presently preferred embodiments of our invention, we form the ribs and grooves by superimposing a plurality of generally elongated ribs on the area scraped by the strokes of the device, and in such a way that the ribs are collectively arrayed in generally spaced parallel relationship to one another and pairs of the ribs form grooves in the spaces therebetween having a substrate of flexible material at the bottoms thereof that is generally co-parallel, if not coplanar with the body of the garment circumposed thereabout. Moreover, we connect the plurality of ribs to the body of the garment so that the lengths of the respective ribs and grooves extend generally crosswise the strokes of the device when the garment is worn by the user, and collectively, the array of ribs and grooves corresponds to the area scraped by the device. We also employ ribs which rise relatively peripherally outwardly from the bottoms of the grooves to a height at which, in relation to the width of the grooves, the ribs will sustain the strokes of the device at an elevation above the bottoms of the grooves at which the substrate is protected from abrasion.

There are several ways in which we may superimpose the plurality of ribs on the area scraped by the strokes of the device and connect the ribs to the body of the garment. In certain presently preferred embodiments of our invention, for example, we superimpose the ribs on that portion of the body of the garment coinciding with the area itself, and directly connect the ribs to the portion so that the portion forms a substrate for the ribs and grooves. In other embodiments, we form a slot in the body of the garment at the site of and corresponding to the area scraped by the strokes of the device; and we insert a patch of substrate material having the aforedescribed array of ribs and grooves thereon, in the slot, and secure the patch to the body of the garment so that the patch is disposed generally coplanar with the portion of the body of the garment circumposed thereabout, and the lengths of the respective ribs and grooves extend generally crosswise the strokes of the device when the garment is worn by a user. We may also overlay such a patch on the portion of the body of the garment coinciding with the area scraped by the device, and secure the patch to the body of the garment, co-parallel therewith, to create a corduroyed surface on the area. However, when we do so, we once again produce a relatively stiff "spot" at that portion of the body of the garment, and though the spot is not as hard and inflexible as that created by a prior art patch, it nevertheless increases the weight of the portion, as well as the weight of the overall garment. Where the portion is the ankle portion of a pant leg or the like, the patch also increases the difficulty of closing the portion about the user's own ankle or the like. Therefore, we find that such an overlaid patch is a far less desirable embodiment of our invention than those mentioned previously.

The duality of preserving the flexibility of the garment while protecting it against mechanical wear at the area which is scraped by the device, is an important advantage of our invention. While we typically make the substrate soft and flexible, as indicated, to preserve the flexibility in the garment itself, we may construct the ribs themselves of an abrasion-resistant polymer material which is more rigid relative to the substrate material, or of a reinforced cloth material which is sufficiently hard and inflexible to be abrasion resistant. In addition to it being flexible, we may also construct the substrate of a material which is pliable and even somewhat stretchable, to render the substrate itself more pliable and stretchable, if desired.

For ease of assembly, we preferably employ ribs which are continuous from one end of the area to the end thereopposite; but we may subdivide individual ribs into segments lengthwise thereof, and we may stagger the segments from rib to rib so as to assure that the strokes of the device are sustained by the ribs at an elevation above the bottoms of the grooves to protect the substrate as indicated.

In addition to making them protrusive, we may also make the ribs bulbous in cross section, such as cylindrical in cross section transverse the longitudinal axes thereof, but equip them with one or more laterally projecting flanges thereon with which we can secure them to a substrate, if necessary, whether that be the body of the garment itself or a patch. We may also secure the ribs to the patch as overlays thereon, or insert them in kerfs therein.

We may also provide hollows in the ribs, extending lengthwise thereof. For example, where the ribs are made of a polymer material, we may make them either solid or hollow, assuming that the bodies of the hollow ribs have sufficient capability to sustain the strokes of the device as indicated. Where the ribs are made of a cloth material, we may form the ribs as inverted U-shaped folds of the material having elongated bolts of a cording material enwrapped therewithin to add bulk and stiffiless to the ribs. In some embodiments of this type, we use strips of rib-forming material, fold the strips into inverted U-shaped folds of the same having one or more laterally projecting flanges thereon, and enwrap bolts of cording material in the bights of the folds.

Because of the many options available to us, our invention lends itself to being supplied as a kit with which a user may protect an area of his or her garment that, in use, is scraped by the strokes of an abrasive device. The kit may comprise a set of the aforementioned polymer or cloth ribs having laterally projecting flanges thereon with which to secure the respective ribs to the body of the garment at the portion thereof coinciding with the area scraped by the device, and sufficient in number to form an array of ribs and grooves corresponding to the area scraped by the device, and the ribs of which have the height described when mounted and arrayed in the manner described. Or the kit may comprise a patch of flexible substrate material which has an array of alternately successive relatively raised ribs and recessed grooves thereon to form a corduroyed surface at one side thereof, and the respective ribs of which rise peripherally outwardly from the bottoms of the grooves to a height at which, in relation to the width of the grooves, the ribs will sustain the strokes of the device at an elevation above the bottoms of the grooves at which the area of the garment is protected from abrasion, when a slot is formed in the body of the garment at and corresponding to the area scraped by the strokes of the device, and the patch is inserted in the slot and secured to the body of the garment so as to be substantially coplanar with the portion of the body of the garment circumposed about the slot and to orient the respective ribs and grooves crosswise the strokes of the device when the garment is worn by a user. One advantage of the patch, is that the set of ribs can be pre-arrayed on the substrate of the patch so that the person to whom the patch is supplied need only insert the patch in a slot in the garment, and secure the patch to the garment in the orientation needed to assure that the ribs and grooves extend crosswise the strokes of the device as described. In some embodiments of our invention, the patch comprises a plurality of elongated strips of flexible groove-bottom-forming material and abrasion resistant rib-forming material, which are alternately arrayed and interconnected with one another to form a generally planar but flexible composite thereof that will span the area which is scraped by the strokes of the device when the garment is worn by a user. In one group of these embodiments, the strips of groove-bottom-forming material are formed by a monolithic piece of the groove-bottom-forming material that has spaced parallel kerfs therein for receiving the strips of rib-forming material.

BRIEF DESCRIPTION OF THE DRAWINGS

These features will be better understood by reference to the accompanying drawings wherein we have illustrated several presently preferred embodiments of our invention, including certain of our methods for creating a corduroyed surface on the body of a garment, such as a pair of ski pants, at the site of an area thereon, such as the inside portion of the ankle of each pant leg, which is scraped by an externally applied abrasive device, such as the edge of a ski.

In the drawings:

FIG. 1 is a front elevational view of a skier at a time when the ski on his left foot is scraping the ankle of the pantleg on his right leg to give rise to the need for protecting the ankle of that pantleg.

FIG. 2 is an inside elevational view of the ankle of each pantleg as it was protected against the scraping action of the opposing ski in the prior art;

FIG. 3 is a perspective view of a pair of ski pants equipped with corduroyed patches at the insides of the ankles thereof, in accordance with our invention;

BEST MODE FOR CARRYING OUT THE INVENTION

Figure 4:
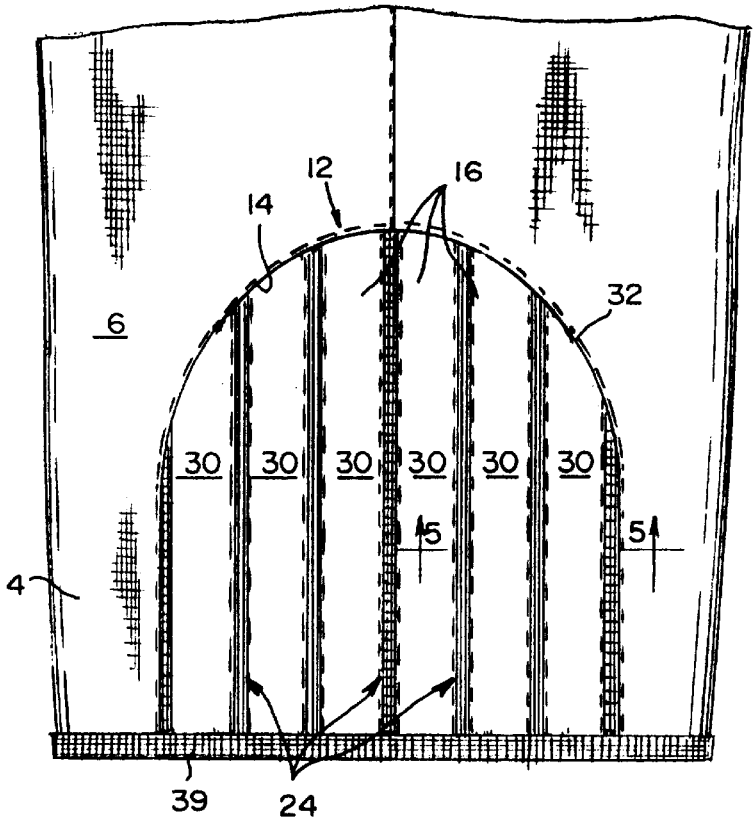
FIG. 4 is an inside elevational view of one pantleg in FIG. 3, illustrating the alternately ribbed and grooved character of the inventive patches.

Referring first to FIGS. 1–6, it will be seen that in the prior art, a patch 2 of plain surfaced, abrasion resistant broadcloth material was superimposed on the ankle portion 4 of each pantleg 6, at the inside thereof, to protect that area of the pantleg from the strokes of the opposing ski 8 when the wearer 10 maneuvered his or her skis up and down and back and forth in making turns and traversing slopes as in FIG. 1. Now however, in accordance with our invention, each plain surfaced patch 2 is replaced by a patch 12 which is corduroyed in cross section and incorporated in the ankle portion 4 of the pantleg 6 to reinforce the ankle portion against abrasion. Although the inventive patch 12 might be employed as an overlay on the body of the ankle portion, it is preferably employed as an insert which is positioned in a slot 14 in the ankle portion 4 and secured to the ankle portion substantially coplanar with the body of the pantleg circumposed thereabout. In this way, the advantages of greater flexibility, lightness, and a more pleasing appearance are better attained while the ankle portion is still reinforced against the strokes of the opposing ski.

More specifically, the insert 2 is fashioned from a plurality of elongated alternately arrayed strips of pant fabric material 16 and abrasion resistant rib-forming material 18 which are sewn or otherwise secured to one another to form a composite thereof having a generally planar substrate 20. The pant fabric material 16 is commonly selected for its flexibility and pliability, and sometimes even for a slight degree of stretchability, so as to make the substrate 20 itself readily flexible. The rib-forming material 18 is commonly selected from one of the various highly abrasion resistant nylon materials which are sold under the trademarks of KEVLAR, CORDURA, or SPECTRA. To fashion the insert, first the strips of rib-forming material 18 are folded into inverted U-shaped folds of the same, then bolts of abrasion-resistant cording 22 are inserted in the bights of the respective folds, and then the respective folds are pinched together to envelope the bolts in the folds. The folds are then cross stitched adjacent the bolts to form nail-head piping style ribs 24 therefrom having laterally projecting flanges 26 below the necks thereof. Next, the longitudinally extending edges 28 of the elongated strips of pant fabric material 16 are reentrantly folded and sewn or otherwise secured to the tops of the flanges 26 of adjacent pairs of ribs 24 to form the composite. The alternately arrayed strips of pant fabric material 16 and rib-forming material 18 are shaped, meanwhile, to give the composite any desired outline, such as the arched outline seen in FIGS. 4 and 6. In addition, the two sets of strips 16 and 18 are selected to provide any desired color combination, say, strips 16 of one color and strips 18 of a differing color. Often, the strips 16 are of the same color as that of the pantleg, while the strips 18 are of a differing and more highly distinctive color so as to highlight the ribs 24 against the background color of the pantleg. Finally, though the pattern of ribs 24 and grooves 30 therebetween may be sufficiently extensive to provide a corduroyed effect across the entire area of the patch 12, conceivably the pattern may also be smaller in area so long as it is sufficiently extensive to correspond to the area scraped by the opposing ski 8. Given such a patch then, a slot 14 of corresponding area is formed in the ankle of the pantleg, and the patch 12 is positioned in the slot substantially coplanar with the body of the pantleg circumposed thereabout. The patch is then sewn to the rim of the slot after the edge 32 of the rim is folded reentrantly to add strength to the joint formed about the rim.

Figure 5:
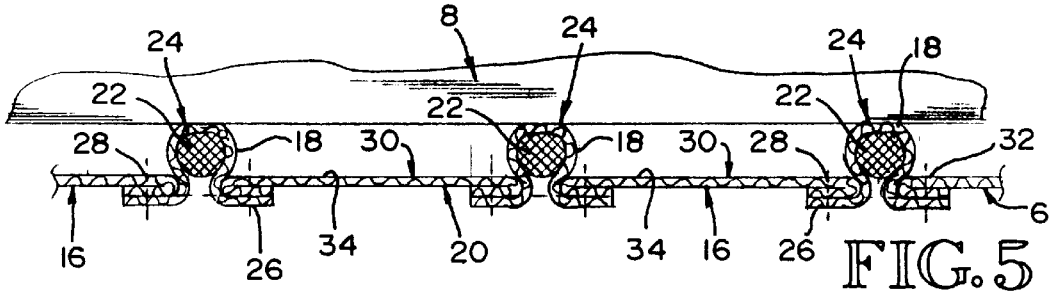
FIG. 5 is a cross section taken along the line 5—5 of FIG. 4, illustrating not only the cross sectional character of each inventive patch, but also the fact that when a ski is stroked across the patch, the strokes of it are sustained by the ribs at an elevation above the bottoms of the grooves in the patch to protect the substrate of the patch from abrasion.
Figure 6:
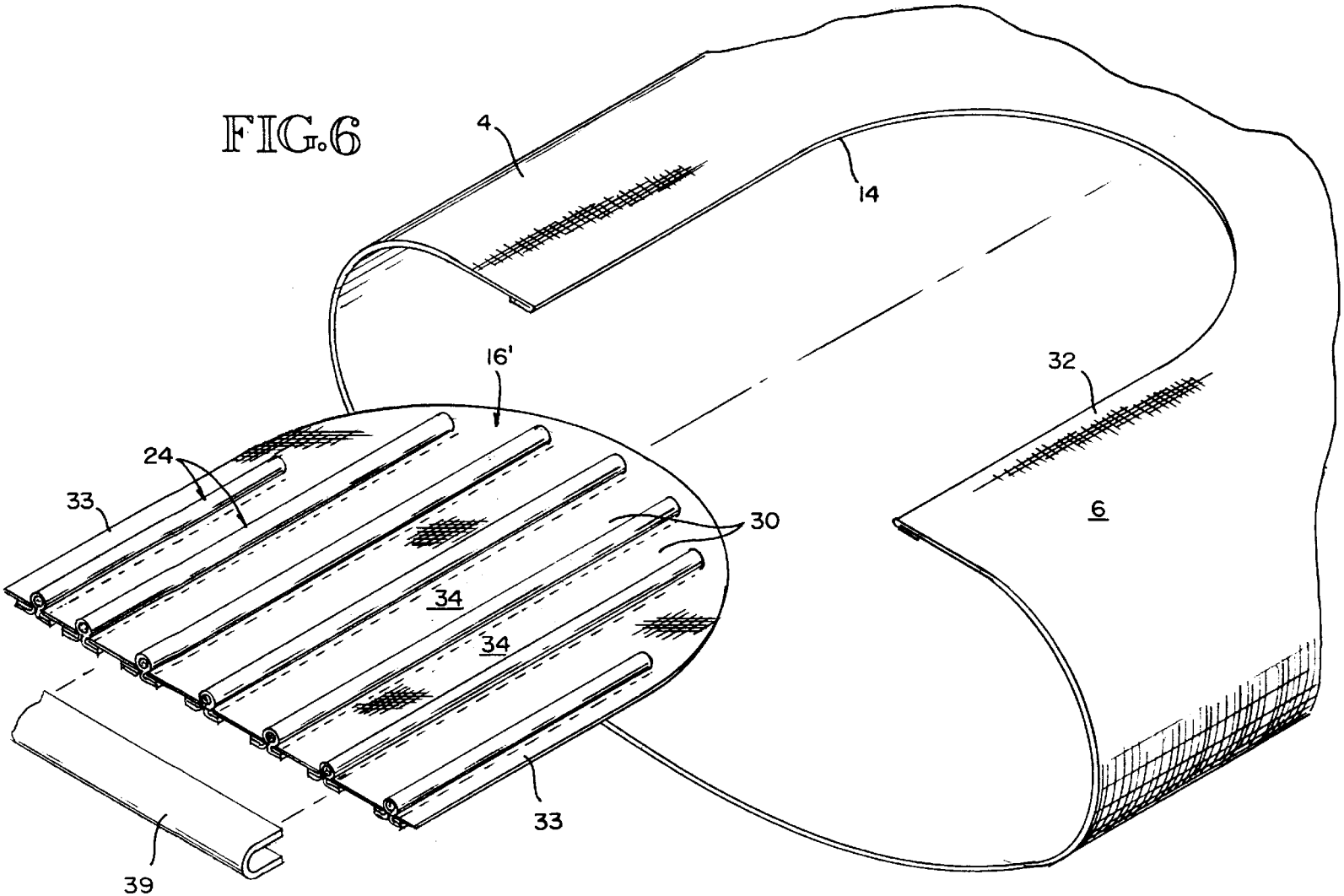
FIG. 6 is an exploded perspective view of the ankle portion of the pantleg and the patch for the same in FIG. 4, illustrating the manner in which the patch is fabricated as an insert for a slot in the ankle portion before a trim strip is added to the bottom of the pantleg, and also illustrating a variation on the patch of FIGS. 3 and 4 wherein instead of being separate strips, the groove-bottom-forming strips of the patch are now formed by a monolithic piece of the groove-bottom-forming material having spaced parallel kerfs therein for the ribs of the patch.

The strips 16 of the patch 12 may be formed from a monolithic piece of fabric 16', as shown in FIG. 6, such as by cutting T-shaped kerfs in the same and reentrantly folding the opposing edges of each kerf to enable a rib 24 to be secured to the fabric at the kerf as shown. Or the strips 16 may be a set of separate strips which are secured to ribs 24 that extend from the bottom to the top of the patch as shown in FIGS. 4 and 5. Additionally, the reentrantly folded sides of the edge 32 of the rim of the slot 14 may be directly sewn to the relatively outside flanges 26 of the adjacent ribs, as in FIGS. 4 and 5, or narrow peripheral flanges 33 of the fabric 16' may be secured to the adjacent sides of the edge 32 of the rim, as in FIG. 6.

FIG. 5 also illustrates that when a ski 8 is stroked across the top of a patch 12, the ribs 24 of the patch sustain the ski at an elevation above the bottoms 34 of the grooves 30 in the patch to protect the substrate 20 of the patch from abrasion.

Figure 7:
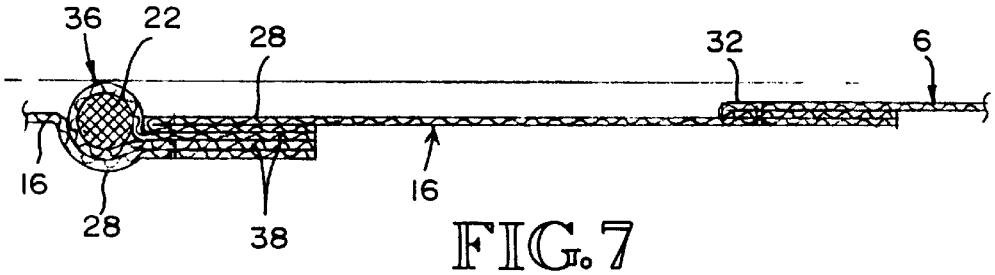
FIG. 7 is a cross section through an alternative and less desirable form of patch wherein the ribs are formed more in the plane of the substrate for ease of manufacture, but also with less ability to provide the height needed to sustain the strokes of the ski at an elevation above the bottoms of the grooves.

In FIG. 7, each rib-forming fold 36 has a bolt of cording 22 enveloped in the bight thereof, before the fold is laid over against the longitudinal edge 28 of an adjacent strip of pant fabric material 16 and mated to the same as in FIG. 7. The adjacent longitudinal edge 28 of the next strip of pant fabric material is then reentrantly folded and laid on top of the legs 38 of the rib-forming fold 36 before the full assembly is stitched together across the legs. While this version of the ribs makes each patch simpler and cheaper to fabricate, it has the distinct disadvantage that the ribs may not upstand at a height which is best suited to sustain a ski above the bottom of the grooves. Therefore, the version seen in FIGS. 3–6 is greatly preferred over that of FIG. 7.

In each version, a trim strip 39 is added to the bottom of each pantleg after a patch 12 is inserted therein.

Figure 8:
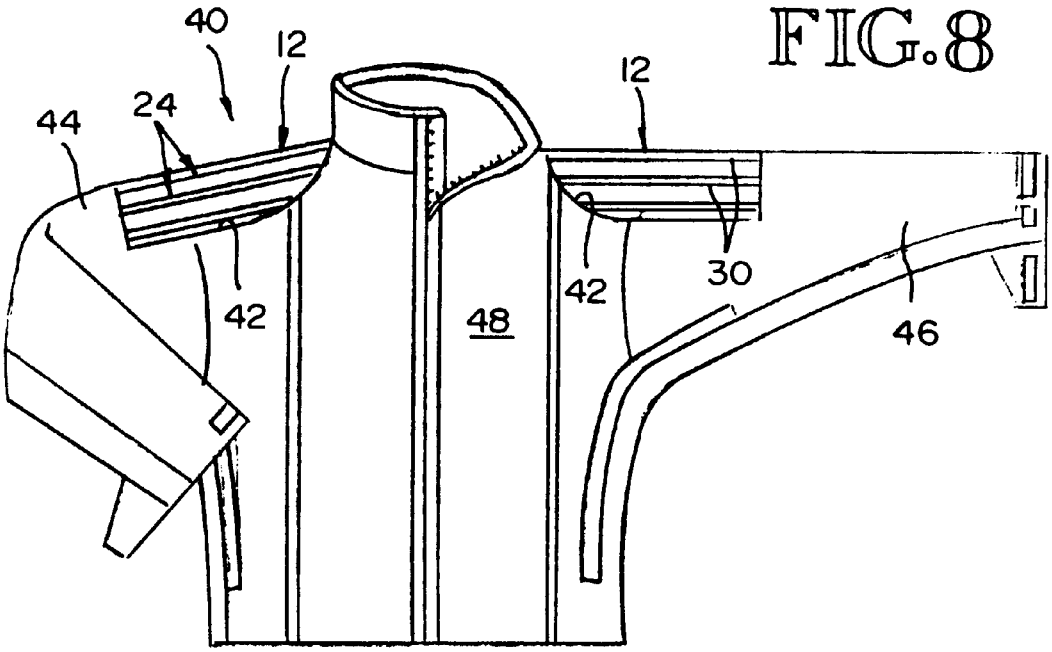
FIG. 8 is a front elevational view of a ski jacket equipped with epaulet-appearing patches at the shoulders thereof, either in slots removed from the plane of the shoulders or as patches superimposed on the bodies of the shoulders.

In FIG. 8, a ski jacket 40 has corduroyed patches 12 similar to those seen in FIGS. 3–6, inserted in slots 42 in the shoulders 44 thereof, and substantially coplanar with the arms 46, chest 48 and back (not shown) of the jacket, to provide ribs 24 for sustaining a ski or skis above the bottoms 34 of the grooves 30 when skis are transported by a skier on one or both of his or her shoulders.

Figures 9, 10:
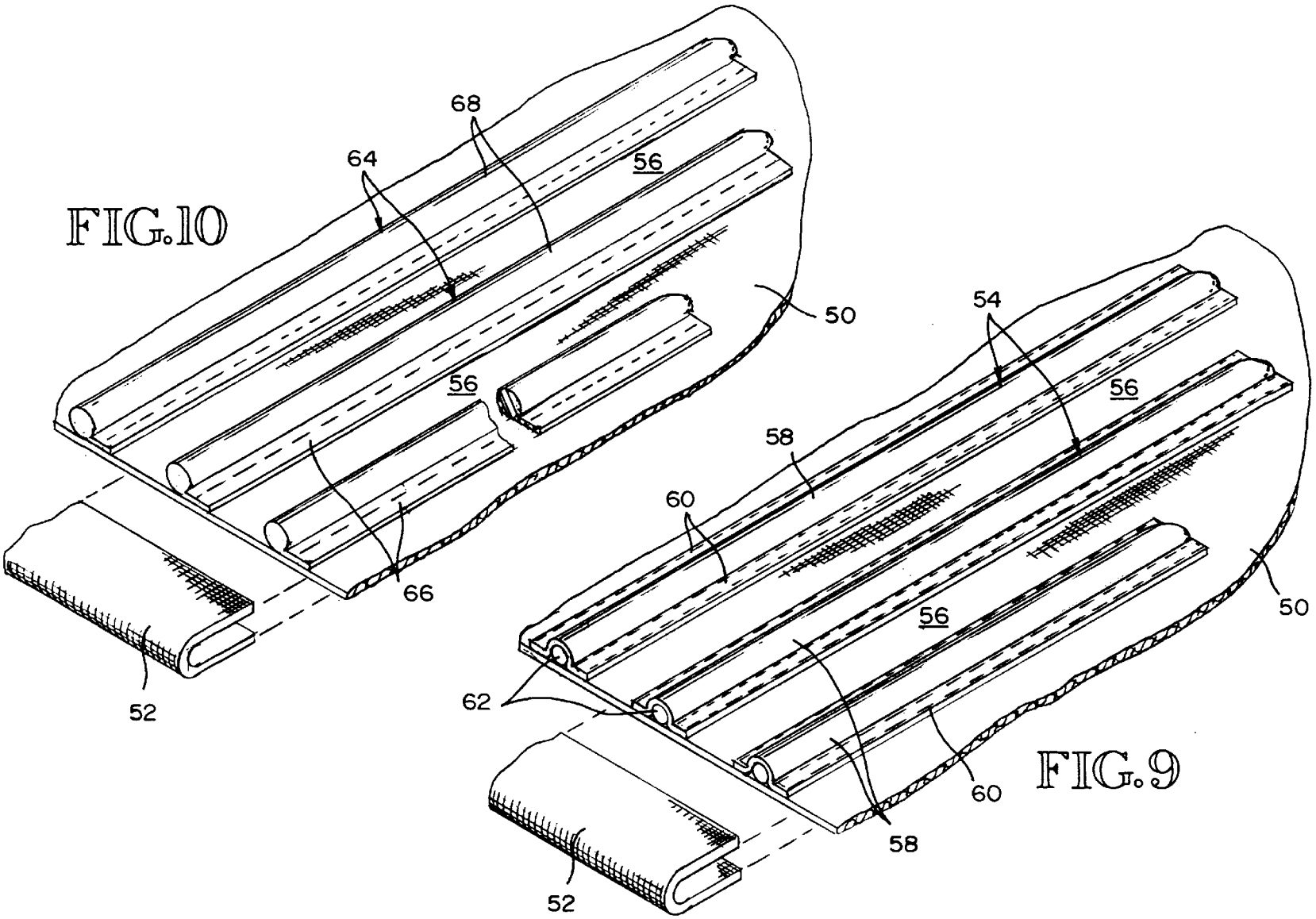
FIG. 9 is an exploded part perspective view of the inside portion of the ankle of a pant leg, having a set of elongated ribs of the type seen in FIGS. 3–5, overlaid directly thereon, rather than on a patch inserted in a slot in the portion.
FIG. 10 is a view similar to FIG. 9, but showing a set of solid elongated P-cross sectioned polymer ribs overlaid on the portion of the ankle of the pant leg instead.

In FIG. 9, the inside portion of the pant leg of a bib suit or a pair of ski pants can be seen at 50 and the trim for the same at 52. This is the portion which is scraped by the action of the opposing ski when the bib suit or pair of pants is worn by a user. In the simplest version of our invention, a set of individual ribs 54 is overlaid in spaced parallel array on the portion 50 and secured to the same so that the portion itself forms a substrate for the ribs 54 and the grooves 56 therebetween. As in FIGS. 3–5, moreover, the ribs 54 are formed as U-shaped folds 58 of abrasive-resistant fabric or cloth material having oppositely disposed laterally projecting flanges 60 thereon, and an elongated bolt of abrasion-resistant cording material 62 enwrapped therewithin at the bights of the fold. And once again, as when we secured the ribs 24 to the patches 16 in FIGS. 3–5, the ribs 54 are secured to the portion 50 by sewing or otherwise fastening the flanges 60 of the same to the portion.

In FIG. 10, the ribs 64 are not only protrusive and bulbous, like the ribs 54 in FIGS. 3–5 and 9, but in addition, the ribs 64 are equipped with a single laterally projecting flange 66 thereon, as in FIG. 7. This gives the ribs 64 the height advantage of FIGS. 3–5 and 9, while providing for cheapness and ease of attachment as in FIG. 7. The combination flows from using ribs fabricated from a polymer material and molded into a P-shaped cross section transverse the longitudinal axes thereof. This cross section enables the ribs to be overlaid sidewise on the portion 50 of the pant leg, and secured at the flanges 66 thereof so that the cylindrical portions 68 of the ribs upstand on the portion 50 with a protrusive, bulbous effect. Yet, given an appropriate polymer material, such as one of the aforementioned vinyl materials, the ribs 64 need not be rigid lengthwise thereof, but can be substantially semi-rigid, particularly relative to the flexible pant material providing the substrate for them. In this way, they can have an ability to flex along with the pant material itself, while providing sufficient abrasion-resistant bulk, height and durability to sustain repeated strokes of a ski edge when the garment is worn by a user.

For ski pants and shoulders, we find that about 3–4 mm of rib height for about 36 mm of groove width, is sufficient to safeguard the groove bottoms against abrasion.

We claim:

1. A method of protecting a localized outwardly oriented area of an outer garment against mechanical wear, because when the outer garment is worn by a user as his/her outermost garment, the area thereof is scraped by the strokes of an abrasive device applied thereto from the atmosphere ambient to the outer garment, comprising:

forming a corduroyed outwardly oriented surface of alternately successive relatively raised ribs and recessed grooves on the area, constructing the ribs of the surface with a structure and material adapted to resist the highly abrasive action of the device, and elevating the ribs of the surface relatively peripherally outwardly into the ambient atmosphere of the outer garment from the bottoms of the grooves to a height at which, in relation to the width of the grooves, the ribs will sustain the strokes of the device at an elevation above the bottoms of the grooves at which the area of the outer garment is protected from the abrasive action of the device.

2. The method according to claim 1 wherein the surface is formed by superimposing a plurality of generally elongated ribs on the area scraped by the strokes of the device, and in such a way that the ribs are collectively arrayed in generally spaced parallel relationship to one another, and pairs of the ribs form grooves in the spaces therebetween having a substrate of flexible material at the bottoms thereof that is generally co-parallel with the body of the garment circumposed thereabout, and connecting the plurality of ribs to the body of the garment so that the lengths of the respective ribs and grooves extend generally crosswise the strokes of the device when the garment is worn by the user, and collectively the array of ribs and grooves corresponds to the area scraped by the device, the ribs rising relatively peripherally outwardly from the bottoms of the grooves to a height at which, in relation to the width of the grooves, the ribs will sustain the strokes of the device at an elevation above the bottoms of the grooves at which the substrate is protected from abrasion.

3. The method according to claim 2 wherein the ribs are superimposed on and directly connected to that portion of the body of the garment coinciding with the area, so that the portion forms a substrate for the ribs and grooves.

4. The method according to claim 2 wherein the ribs are constructed of an abrasion-resistant polymer material which is semi-rigid relative to the substrate material.

5. The method according to claim 2 wherein the ribs are constructed of a reinforced cloth material which is sufficiently hard and inflexible to be abrasive resistant.

6. The method according to claim 2 wherein the ribs are bulbous in cross section transverse the longitudinal axes thereof, and equipped with laterally projecting flanges thereon, and the ribs are secured to the substrate at the flanges thereof.

7. The method according to claim 2 wherein a slot is formed in the body of the garment at the site of and corresponding to the area scraped by the strokes of the device, and a patch of substrate material having the aforedescribed array of ribs and grooves thereon, is inserted in the slot, and secured to the body of the garment so that the patch is disposed generally coplanar with the portion of the body of the garment circumposed about the slot, and the lengths of the respective ribs and grooves extend generally crosswise the strokes of the device when the garment is worn by a user.

8. The method according to claim 7 wherein the ribs are secured to the patch as overlays thereon.

9. The method according to claim 7 wherein the patch has spaced parallel kerfs therein and the ribs are inserted in the kerfs.

10. The method according to claim 2 wherein the ribs have hollows therein extending lengthwise thereof.

11. The method according to claim 2 wherein the ribs are made of a cloth material and formed as inverted U-shaped folds of the same, and elongated bolts of cording material are enwrapped within the folds to add bulk and stiffness to the ribs.

12. In combination, an outer garment having a localized outwardly oriented area thereof which is scraped by the strokes of an abrasive device applied thereto from the atmosphere ambient to the outer garment when the outer garment is worn by a user as his/her outermost garment, and means defining a corduroyed outwardly oriented surface on the area having alternately successive relatively raised ribs and recessed grooves thereon and therein, respectively, the ribs of which have a structure and material adapted so that the ribs resist the highly abrasive action of the device and rise peripherally outwardly into the ambient atmosphere from the bottoms of the grooves to a height at which, in relation to the width of the grooves, the ribs will sustain the strokes of the device above the bottoms of the grooves at an elevation at which the area of the outer garment is protected from the abrasive action of the device.

13. The combination according to claim 12 wherein the surface has a substrate of flexible material and a plurality of generally elongated relatively raised ribs superimposed on the substrate in such a way that the ribs are collectively arrayed in generally spaced parallel relationship to one another and pairs of the ribs form grooves in the spaces therebetween having the substrate at the bottoms thereof, the substrate being connected to the garment so that the substrate is generally co-parallel with the body of the garment circumposed thereabout, and the plurality of ribs being connected to the substrate so that the lengths of the respective ribs and grooves extend generally crosswise the strokes of the device when the garment is worn by the user, and collectively the array of ribs and grooves corresponds to the area scraped by the device.

14. The combination according to claim 13 wherein that portion of the body of the garment coinciding with the area forms the substrate.

15. The combination according to claim 13 wherein the body of the garment has a slot therein at the site of and corresponding to the area scraped by the strokes of the device, and a patch of substrate material having the aforedescribed array of ribs and grooves thereon, is inserted in the slot and secured to the body of the garment so that the patch is disposed generally coplanar with the portion of the body of the garment circumposed about the slot, and the lengths of the respective ribs and grooves extend generally crosswise the strokes of the device when the garment is worn by a user.

16. The combination according to claim 13 wherein the ribs are constructed of an abrasion-resistant polymer material which is semi-rigid relative to the substrate material.

17. The combination according to claim 13 wherein the ribs are constructed of a reinforced cloth material which is sufficiently hard and inflexible to be abrasion-resistant.

18. The combination according to claim 13 wherein the ribs are continuous from one end of the area to the end of the area thereopposite.

19. The combination according to claim 13 wherein the ribs are bulbous in cross section transverse the longitudinal axes thereof, but equipped with laterally projecting flanges thereon, and the ribs are secured to the substrate at the flanges.

20. The combination according to claim 13 wherein the ribs are secured to the substrate as overlays thereon.

21. The combination according to claim 13 wherein the substrate has spaced parallel kerfs therein, and the ribs are inserted in the kerfs.

22. The combination according to claim 13 wherein the ribs have hollows therein, extending lengthwise thereof.

23. The combination according to claim 13 wherein the ribs are made of a cloth material, and are formed as inverted U-shaped folds of the same, and have elongated bolts of a cording material enwrapped within the folds to add bulk and stiffness to the ribs.

24. A method of protecting a localized area of a garment against mechanical wear, because when the garment is worn by a user, the area thereof is scraped by the strokes of an externally applied abrasive device, comprising:

forming a corduroyed surface of alternately successive relatively raised ribs and recessed grooves on the area, and raising the ribs of the surface relatively peripherally outwardly from the bottoms of the grooves to a height at which, in relation to the width of the grooves, the ribs will sustain the strokes of the device at an elevation above the bottoms of the grooves at which the area of the garment is protected from abrasion, the surface being formed by superimposing a plurality of generally elongated ribs on the area scraped by the strokes of the device, and in such a way that the ribs are collectively arrayed in generally spaced parallel relationship to one another, and pairs of the ribs form grooves in the spaces therebetween having a substrate of flexible material at the bottoms thereof that is generally co-parallel with the body of the garment circumposed thereabout, and connecting the plurality of ribs to the body of the garment so that the lengths of the respective ribs and grooves extend generally crosswise the strokes of the device when the garment is worn by the user, and collectively the array of ribs and grooves corresponds to the area scraped by the device, the ribs rising relatively peripherally outwardly from the bottoms of the grooves to a height at which, in relation to the width of the grooves, the ribs will sustain the strokes of the device at an elevation above the bottoms of the grooves at which the substrate is protected from abrasion, and a slot being formed in the body of the garment at the site of and corresponding to the area scraped by the strokes of the device, and a patch of substrate material having the aforedescribed array of ribs and grooves thereon, being inserted in the slot, and secured to the body of the garment so that the patch is disposed generally coplanar with the portion of the body of the garment circumposed about the slot, and the lengths of the respective ribs and grooves extend generally crosswise the strokes of the device when the garment is worn by a user.

25. The method according to claim 24 wherein the ribs are secured to the patch as overlays thereon.

26. The method according to claim 24 wherein the patch has spaced parallel kerfs therein and the ribs are inserted in the kerfs.

27. In combination, a garment having a localized area thereof which is scraped by the strokes of an externally applied abrasive device when the garment is worn by a user, and means defining a corduroyed surface on the area having alternately successive relatively raised ribs and recessed grooves thereon and therein, respectively, the ribs of which rise peripherally outwardly from the bottoms of the grooves to a height at which, in relation to the width of the grooves, the ribs will sustain the strokes of the device above the bottoms of the grooves at an elevation at which the area of the garment is protected from abrasion, the surface having a substrate of flexible material and a plurality of generally elongated relatively raised ribs superimposed on the substrate in such a way that the ribs are collectively arrayed in generally spaced parallel relationship to one another and pairs of the ribs form grooves in the spaces therebetween having the substrate at the bottoms thereof, the substrate being connected to the garment so that the substrate is generally co-parallel with the body of the garment circumposed thereabout, and the plurality of ribs being connected to the substrate so that the lengths of the respective ribs and grooves extend generally crosswise the strokes of the device when the garment is worn by the user, and collectively the array of ribs and grooves corresponds to the area scraped by the device, and the body of the garment having a slot therein at the site of and corresponding to the area scraped by the strokes of the device, and a patch of substrate material having the aforedescribed array of ribs and grooves thereon, being inserted in the slot and secured to the body of the garment so that the patch is disposed generally coplanar with the portion of the body of the garment circumposed about the slot, and the lengths of the respective ribs and grooves extend generally crosswise the strokes of the device when the garment is worn by a user.

28. In combination, a garment having a localized area thereof which is scraped by the strokes of an externally applied abrasive device when the garment is worn by a user, and means defining a corduroyed surface on the area having alternately successive relatively raised ribs and recessed grooves thereon and therein, respectively, the ribs of which rise peripherally outwardly from the bottoms of the grooves to a height at which, in relation to the width of the grooves, the ribs will sustain the strokes of the device above the bottoms of the grooves at an elevation at which the area of the garment is protected from abrasion, the surface having a substrate of flexible material and a plurality of generally elongated relatively raised ribs superimposed on the substrate in such a way that the ribs are collectively arrayed in generally spaced parallel relationship to one another and pairs of the ribs form grooves in the spaces therebetween having the substrate at the bottoms thereof, the substrate being connected to the garment so that the substrate is generally co-parallel with the body of the garment circumposed thereabout, and the plurality of ribs being connected to the substrate so that the lengths of the respective ribs and grooves extend generally crosswise the strokes of the device when the garment is worn by the user, and collectively the array of ribs and grooves corresponds to the area scraped by the device, and the substrate having spaced parallel kerfs therein, and the ribs being inserted in the kerfs.

* * * * *